United States Patent [19]

Dworkin

[11] 4,300,248

[45] Nov. 17, 1981

[54] SNAP-IN SOAP DISH LINER FOR BATHROOM FIXTURES

[76] Inventor: Eugene Dworkin, 16-66 Bell Blvd., Bayside, N.Y. 11360

[21] Appl. No.: 117,974

[22] Filed: Feb. 5, 1980

[51] Int. Cl.[3] ..... A47K 5/00; A47K 5/05; A47B 67/02

[52] U.S. Cl. ..... 4/628; 4/511; 4/559; 4/576; 4/658; 248/27.3; 312/242; D6/90

[58] Field of Search ..... 4/538, 496, 511, 559, 4/576, 577, 605, 628, 630, 654, 661, 609, 658; 248/27.3; D6/86, 89, 90; 312/242, 351

[56] References Cited

U.S. PATENT DOCUMENTS

| | | | |
|---|---|---|---|
| D. 85,459 | 11/1931 | Baker | D6/90 |
| D. 203,331 | 12/1965 | Lanczi | D6/89 |
| 2,489,550 | 11/1949 | Visser | 312/242 X |
| 2,585,743 | 2/1952 | Cooper, Jr. | 312/242 X |
| 2,987,360 | 6/1961 | Popick | 312/242 X |
| 3,022,602 | 2/1962 | Turek et al. | 312/242 |
| 3,054,211 | 9/1962 | Hawk et al. | 312/351 |
| 3,185,537 | 5/1965 | Wright | D6/90 X |
| 3,323,850 | 6/1967 | Link | 312/351 X |
| 3,793,563 | 2/1974 | Brefka | 248/27.3 X |
| 4,063,660 | 12/1977 | Ware | 248/27.3 X |

*Primary Examiner*—Stuart S. Levy
*Attorney, Agent, or Firm*—Kirschstein, Kirschstein, Ottinger & Cobrin

[57] ABSTRACT

A soap dish liner is inserted with snap-type engagement into a bathroom fixture soap dish recess which is integrally built into a bathroom wall that is located adjacent to a bathtub and/or shower area. The liner has wall portions which shield the soap in its interior soap compartment from water, thereby preventing soap dissolution.

8 Claims, 2 Drawing Figures

SNAP-IN SOAP DISH LINER FOR BATHROOM FIXTURES

BACKGROUND OF THE INVENTION

1. Field of the Invention

This invention generally relates to soap dishes and, more particularly, to soap dish liners which are inserted with snap-type engagement into a built-in bathroom fixture soap dish recess which is formed in a bathroom wall located adjacent to a bathtub and/or shower area.

2. Description of the Prior Art

Conventional bathtub and/or shower areas in bathrooms are equipped with ceramic soap dish recesses which are built into adjacent bathroom walls. The ceramic soap dish recess is typically placed at a low position on a bathroom side wall which is typically impinged by water from an overhead shower. Any soap held in the ceramic soap dish recess is therefore directly exposed to water, thereby causing the soap to soften and eventually dissolve in a pool of water which collects in the bottom of the ceramic soap dish recess.

Many bathroom ceramic soap dish fixtures are equipped with a generally U-shaped handle-washcloth support which is located at the upper region of the ceramic soap dish recess. This support serves as a convenient hand-hold, or as a convenient structure from which a washcloth is hung. This support extends away from the bathroom wall which forms therewith an open space through which water, e.g. from an overhead shower, may directly impinge the soap to eventually dissolve the same.

In order to prevent soap dissolution, bathers have resorted to using auxiliary soap dishes which have some means of water drainage. However, these auxiliary soap dishes are discrete and portable items, are separately movable, are prone to be misplaced, and have not proven to be altogether satisfactory in preventing soap dissolution in practice.

SUMMARY OF THE INVENTION

1. Object of the Invention

Accordingly, it is the general object of the present invention to overcome the aforementioned drawbacks of the prior art.

Another object of the present invention is to convert a built-in ceramic soap dish bathroom fixture to a soap dish which reliably prevents soap dissolution.

Still another object of the present invention is to obviate the need for auxiliary and portable soap dishes.

Another object of the invention is to reliably install a soap dish liner into a ceramic soap dish fixture with snap-type action.

A further object of this invention is to reliably remove a soap dish liner from a ceramic soap dish fixture for convenient cleaning purposes.

Another object of the invention is to shield soap in the ceramic soap dish fixture from being impinged by water entering from above or from the sides of the bathroom fixture.

Still another object of this invention is to provide a modernistic, sculptured soap dish fixture which is attractive in appearance, easy to install and inexpensive to manufacture.

2. Features of the Invention

In keeping with these objects and others which will become apparent hereinafter, one feature of the invention resides, briefly stated, in a soap dish liner which is inserted with snap-type action into a built-in, bathroom fixture, soap dish recess which is formed on a bathroom wall located adjacent to a bathtub and/or shower area. The soap dish liner comprises a housing having resilient wall portions spaced apart of each other to bound a soap compartment. The resilient wall portions are manually movable between a non-installed position and an installed position. In the non-installed position, the resilient wall portions are more closely spaced apart of each other to facilitate convenient insertion of the liner into, and/or removal of the liner from, the built-in recess. In the installed position, the resilient wall portions are more widely spaced apart of each other to engage the bathroom wall portions which form the built-in recess with snap-type action for firmly securing the liner in the built-in recess. The snap-in mounting reliably converts the ceramic soap dish fixture to a soap dish which reliably prevents soap dissolution, and obviates the need for auxiliary soap dishes.

In accordance with another feature of the invention, a generally U-shaped handle-washcloth support is mounted at the upper region of the built-in bathroom fixture soap dish recess. The support has a pair of side extensions which extend outwardly of the bathroom wall at opposite sides of the soap dish recess. The support also has a main extension which extends between the side extensions at a predetermined distance away from the bathroom wall. All of these extensions bound an open space in the upper region of the recess. One of the resilient wall portions, i.e. the top wall portion, of the housing is juxtaposed with this open space and shields the built-in recess from the entry of water from above the same. Other resilient wall portions, for example, the side wall portions, extend outwardly away from the bathroom wall and shield the built-in recess from entry of water in direction laterally of the recess. Both the top and side wall portions thereby reliably prevent soap dissolution due to any water coming from above or from the sides of the bathroom fixture.

Yet another feature is to mount a locking abutment on the top wall portion. The locking abutment snappingly engages the main extension behind the same and in the open space. The locking abutment prevents the liner from unauthorized removal from the built-in recess.

An additional feature is to space the housing above the bottom wall of the built-in recess. This prevents soap in the housing from sitting in a pool of water and dissolving.

Still another feature of the invention is to manufacture the housing of a molded synthetic plastic material such as Lucite. This permits the housing to be molded with a sculptured modernistic appearance, thereby creating an attractive bathroom decor.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
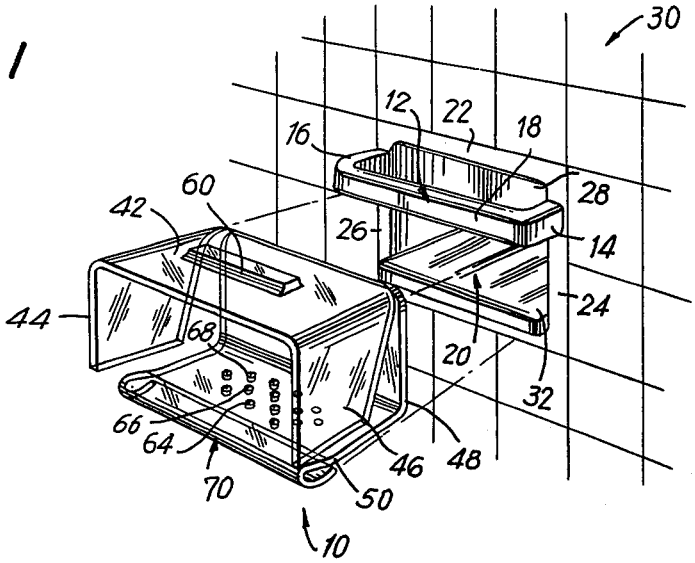
FIG. 1 is a front perspective view of a soap dish liner for snap-in insertion into a built-in bathroom fixture soap dish recess which is formed in a bathroom wall adjacent to a bathtub and/or shower area in accordance with this invention.

Referring now to the drawings, reference numeral 10 generally identifies a soap dish liner for snap-in insertion into a ceramic bathroom fixture soap dish recess 20. The soap dish recess 20 is the conventional bathroom fixture which is built into a bathroom wall 30 which is located adjacent to a bathtub and/or shower area. The conventional built-in recess 20 constitutes an interior soap compartment which is bounded by a top ceramic wall portion 22, a pair of side ceramic wall portions 24,26, a rear ceramic wall portion 28, and a bottom ceramic wall portion 32. The bottom wall 32 is conveniently formed with a set of very shallow grooves 34 for supporting a bar of soap into the interior soap compartment.

Typically, the conventional built-in recess 20 is formed at a relatively low position on the bathroom wall 30. Water, either directly from an overhead shower, or indirectly from splashing, eventually finds its way into the built-in recess 20 and collects therein, to thereby form a pool of water above the bottom ceramic wall 32. This water pool eventually softens the soap bar supported on the bottom wall 32, and eventually causes the soap to dissolve.

In order to convert the built-in recess to a soap dish which reliably prevents soap dissolution, the soap dish liner 10 is snap-mounted into the recess 20. The liner 10 comprises a generally parallelepiped-shaped housing having a plurality of resilient wall portions which are spaced apart of each other in a non-stressed (relaxed) orientation to thereby bound a compartment for a bar of soap 36. The resilient wall portions include a top wall portion 42, a pair of side wall portions 44,46 which are integrally connected to the top wall portion, a rear wall portion 48 which is integrally connected to the top wall portion, and a bottom wall portion 50 which is integrally connected to the rear wall portion.

The resilient wall portions are manually movable away from their non-stressed orientation, e.g. by squeezing them together, to a non-installed stressed orientation (FIG. 1). In the non-installed stressed orientation, the resilient wall portions are more closely spaced apart of each other, as compared to the original unstressed orientation, to facilitate convenient insertion of the liner housing 10 into, and/or removal of the latter from, the recess 20. The resilient wall portions need only be urged towards each other to the extent that they are spaced apart at a distance less than the corresponding distance of the ceramic walls of the recess. For example, the opposite side wall portions 44,46 need be urged towards each other only until they are spaced apart at a distance which is less than the fixed distance between the ceramic side walls 24,26. Likewise, the opposite top and bottom wall portions 42,50 need be urged towards each other only until they are spaced apart at a distance which is less than the fixed distance between the ceramic top and bottom walls 22,32.

Once the manual pressure on the resilient walls is released, the resilient wall portions seek to return from their stressed orientation to their original unstressed orientation due to thier own inherent resilience. Hence, the resilient wall portions move more widely apart of each other, as compared to the non-installed orientation. The top 42, the bottom 50 and the side walls 44,46 of the housing snappingly engage the top 22, bottom 32, and side walls 24,26 of the recess 20, respectively.

The liner 20 is inserted into the recess until the rear resilient wall 48 abuts against the rear ceramic wall 28. The snap-in mounting firmly secures the liner 10 into the recess 20.

In order to remove the liner 10 from the recess, it is merely necessary to urge a pair of opposite resilient wall portions towards each other, and thereupon to pull the liner 10 outwardly from the recess 20.

Referring again to FIG. 1, a conventional handle-washcloth ceramic support 12 is mounted at the upper region of the built-in bathroom fixture recess. The U-shaped support 12 serves as a convenient hand-hold for a bather, or as a convenient structurn from which a washcloth is hung. The support 12 includes a pair of side extensions 14,16 which extend outwardly away from the bathroom wall 30, in orthogonal direction relative thereto. Side extensions 14, 16 are integrally formed with ceramic side walls 24,26, respectively. A main extension 18 extends between the side extensions 14,16 lengthwise along the wall 30 and at a predetermined distance away from the same. The side and main extensions bound an open space 52 (see FIG. 2) in the upper region of the built-in fixture recess.

Figure 2:
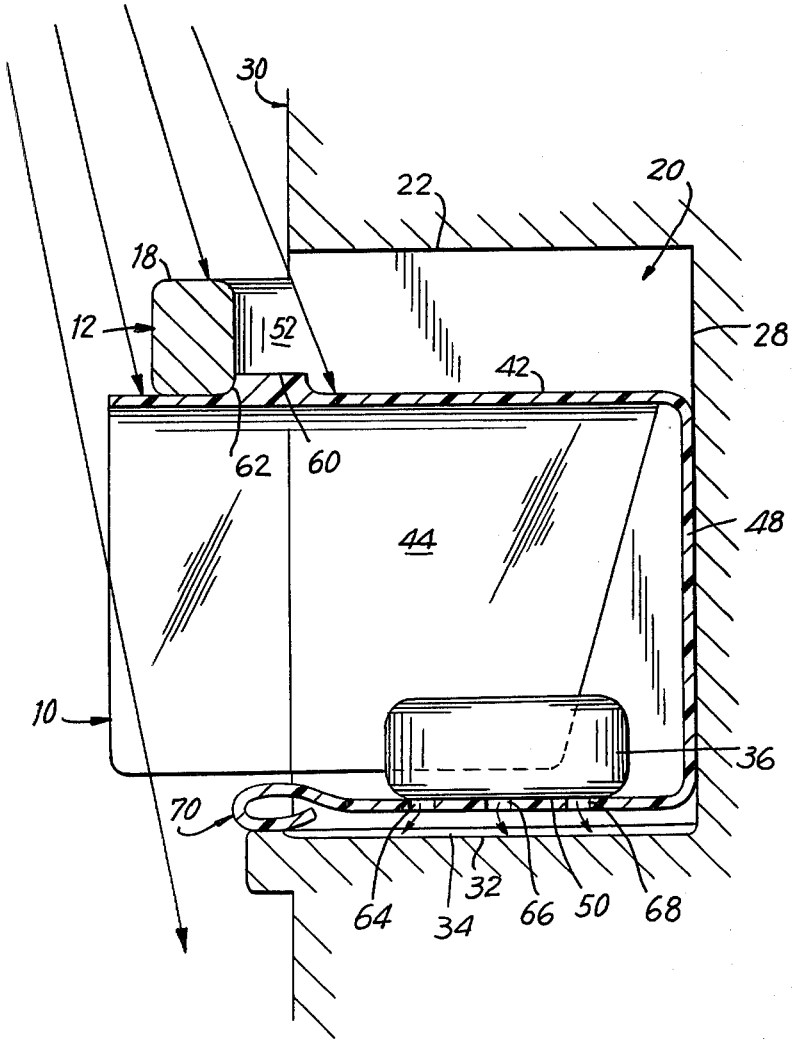
FIG. 2 is an enlarged cross-sectional view of the soap dish liner of FIG. 1 in its installed position in the built-in bathroom fixture recess.

In the prior art, water from an overhead shower travelled along paths as diagrammatically illustrated by straight arrows in FIG. 2, and passed through this open space 52. The soap in the recess would thereby be directly impinged by the water entering from above, eventually resulting in soap dissolution.

In accordance with this invention, the top wall 42 extends outwardly of the recess 20 for a distance sufficient to span the open space 52 and prevent direct water impingement on the soap 36. The top wall 42 underlies the main extension 18 and, preferably, extends slightly forwardly of the same. The top wall serves to shield the soap 36.

Still another feature is the extension of the side walls 44,46 outwardly of the recess 20 for a distance sufficient to clear the main extension 18 and to extend slightly forwardly of the same. The side walls 44,46 shield the soap 36 from being impinged by water entering in a direction generally laterally of the recess.

Locking means 60 are provided for preventing the liner 10 from unauthorized removal from the recess. The locking means 60 includes a snap-in locking abutment 60 mounted on the top wall 42, and preferably of one-piece with the same, so as to participate in joint movement therewith. The locking abutment 60 passes underneath the main extension 18 during initial insertion of the liner 10. When pressure is released on the top wall, the abutment 60 snaps into place behind the main extension, and serves to prevent the liner from falling out of the recess. The abutment 60 is elongated and has a longitudinal groove 62 of complementary contour to the rear surface of the main extension in order to securely seat the abutment in place.

A plurality of drainage holes, e.g. 64,66,68, extend through the bottom wall 50 and are operative to permit any water in the soap compartment to drain therefrom.

The spacing means 70 are provided to space the bottom wall 50 above the ceramic bottom wall 32. The spacing means 70 serves to keep the soap 36 elevated above any water which may tend to collect in the lower region of the recess 20. The spacing means includes a resilient downturned lip 70 of one-piece with the bottom wall 50. The lip 70 bears against a forward extension of the ceramic bottom wall 34, and also serves to securely mount the liner in the recess.

The liner housing can be molded of any resilient material. Currently, a resilient synthetic plastic material such as Lucite is preferred. This type of material has sufficient strength and resilience to be stressed and to return by itself to its initial molded unstressed configuration. For aesthetic purposes, it is preferred if the material is constituted of transparent material so as to match and blend in with the existing bathroom color scheme.

In order to increase the resilience of the resilient wall portions, the inner edges of the side walls 44,46 are tapered. Each corner, where the respective side wall meets the top wall and the rear wall, is cut away so as to provide room through which the wall portions can move without mechanical interference with the other wall portions.

It will be understood that each of the elements described above, or two or more together, may also find a useful application in other types of constructions differing from the types described above.

While the invention has been illustrated and described as embodied in a snap-in soap dish liner for bathroom fixtures, it is not intended to be limited to the details shown, since various modifications and structural changes may be made without departing in any way from the spirit of the prrsent invention.

Without further analysis, the foregoing will so fully reveal the gist of the present invention that others can by applying current knowledge readily adapt it for various applications without omitting features that, from the standpoint of prior art, fairly constitute essential characteristics of the generic of specific aspects of this invention and, therefore, such adaptations should and are intended to be comprehended within the meaning and range of equivalence of the following claims.

What is claimed as new and desired to be protected by Letters Patent is set forth in the appended claims:

1. A soap dish liner for snap-in insertion into a built-in, bathroom fixture, soap dish recess of the type which is formed in a bathroom wall located adjacent to a bathtub and/or shower area, and which includes a generally U-shaped handle-washcloth support having a pair of side extensions which extend outwardly of the bathroom wall at opposite sides of the soap dish recess, and a main extension which extends between the side extensions at a predetermined distance away from the bathroom wall, all of said extensions bounding an open space in the upper region of the built-in soap dish recess, comprising:

a housing having resilient wall portions spaced apart of each other to bound a soap compartment, said resilient wall portions being manually movable between a non-installed position in which the resilient wall portions are more closely spaced apart of each other to facilitate convenient insertion of the liner into, and/or removal of the latter from, the built-in recess, and an installed position in which the resilient wall portions are more widely spaced apart of each other to engage the bathroom wall portions which form the built-in recess with snap-type action for firmly securing the liner in the built-in recess, one of said resilient wall portions being a top shield wall portion which is juxtaposed with said open space and which shields the built-in soap dish recess from the entry of water from above the built-in soap dish recess, for preventing soap dissolution; and locking means for preventing the liner from unauthorized removal from the built-in soap dish recess, including a snap-in locking abutment mounted on the top shield wall portion for joint movement with the latter, said locking abutment being receivable in said open space and behind the main extension to snappingly engage the latter.

2. The soap dish as defined in claim 1, wherein one of said resilient wall portions is a bottom wall portion; and wherein said housing includes water drainage means on the bottom wall portion for permitting any water to drain from the soap compartment.

3. The soap dish as defined in claim 2, wherein the drainage means includes a plurality of drainage holes extending through the bottom wall portion.

4. The soap dish as defined in claim 1, wherein one of said resilient wall portions is a bottom wall portion; and wherein said housing includes means for spacing the bottom wall portion above the corresponding bathroom wall portion of the built-in soap dish recess.

5. The soap dish as defined in claim 4, wherein the spacing means includes a resilient downturned lip of one-piece with the bottom wall portion.

6. The soap dish as defined in claim 1, wherein the resilient wall portions include a pair of side wall portions extending outwardly away from the bathroom wall, each side wall portion shielding the built-in soap dish recess from entry of water in direction laterally of the recess, for preventing soap dissolution.

7. The soap dish as defined in claim 1, wherein the resilient wall portions include a pair of side wall portions of one-piece with the top shield wall portion, a bottom wall portion, and a rear wall portion of one-piece with both the top and bottom wall portions.

8. The soap dish as defined in claim 1, wherein the housing is constituted of a synthetic plastic material.

* * * * *